United States Patent [19]

Hammer

[11] Patent Number: 5,066,187

[45] Date of Patent: Nov. 19, 1991

[54] PARKING SYSTEM AND METHOD OF AUTOMATICALLY PARKING MOTOR VEHICLES

[76] Inventor: Hans Hammer, Sylvensteinstrasse 2, 8000 Munich 70, Fed. Rep. of Germany

[21] Appl. No.: 476,694

[22] Filed: Feb. 8, 1990

[63] Continuation of PCT/EP8900618 Jun. 2, 1989, abandoned.

[51] Int. Cl.[5] ..... E04H 6/12

[52] U.S. Cl. ..... 414/237; 414/239

[58] Field of Search ..... 414/233, 236, 237, 239, 414/240, 231, 252, 264; 198/465.1, 465.2, 465.3, 782

[56] References Cited

U.S. PATENT DOCUMENTS

| | | | |
|---|---|---|---|
| 2,874,857 | 2/1959 | Coursey | 414/240 |
| 3,115,257 | 12/1963 | Kubik | 414/236 X |
| 3,229,826 | 1/1966 | Blacklock et al. | 414/280 |
| 3,330,083 | 7/1967 | Jaulmes | 414/233 X |
| 3,378,151 | 4/1968 | Salloum | 414/233 |
| 3,662,905 | 5/1972 | Mizuno et al. | 414/237 |
| 4,217,070 | 8/1980 | Groger | 414/239 |
| 4,768,914 | 9/1988 | Sing | 414/237 |
| 4,850,472 | 7/1989 | Liebel et al. | 198/465.3 X |
| 4,850,784 | 7/1989 | Salloum | 414/252 X |

FOREIGN PATENT DOCUMENTS

| | | | |
|---|---|---|---|
| 0232725 | 1/1987 | European Pat. Off. . | |
| 2404057 | 7/1975 | Fed. Rep. of Germany | 414/239 |
| 2923601 | 12/1980 | Fed. Rep. of Germany . | |
| 262306 | 10/1988 | Japan | 414/231 |

*Primary Examiner*—David A. Bucci

*Attorney, Agent, or Firm*—Laubscher, Presta & Laubscher

[57] ABSTRACT

A parking system for automatically parking automobiles comprises at least two parking levels (P1, P2) disposed above each other which are served by lifting units (20–23). Each parking level includes parking rows (Z1–Z12) and parking columns (Ra–RK) perpendicular thereto, in which horizontal shifting of the automobiles (40) on pallets (41) is performed fully automatically under control by a computer. The parking rows (Z1–Z12) are arranged in parallel in x-direction and the parking columns (RA–RK) are arranged in y-direction transversely to the entrance zone (EZ) and to an exit zone (AZ). In the entrance row (Z3) and in the exit row (Z1) a lifting unit (20, 21) is respectively provided for each parking column (RA–RK). The pallets of all columns are movable at the parking level (P1) including the entrance zone (EZ) and the exit zone (AZ) in the direction (x) of all of the columns and in at least one row (Z9) in the direction (y) transversely thereto.

13 Claims, 5 Drawing Sheets

PARKING SYSTEM AND METHOD OF AUTOMATICALLY PARKING MOTOR VEHICLES

This is a continuation of internal application PCT/EP 89 00618 with an international filing date of June 2, 1989 which designated the United States of America and which is now abandoned.

BACKGROUND OF THE INVENTION

The present invention is directed to a parking system for automatically parking automobiles comprising parking rows and parking columns perpendicular thereto, in which the automobiles are shifted horizontally on pallets, and comprising an entrance zone and an exit zone.

With increasing road traffic density it becomes increasingly necessary to provide sufficient parking space, especially in places with heavy traffic such as congested city areas (department stores, banks, administrative buildings, cultural facilities, recreational facilities, stadiums etc.), airports, showgrounds or the like, i.e. wherever there is heavy traffic while available parking space is limited and dear.

BRIEF DESCRIPTION OF THE PRIOR ART

The previously constructed conventional parking garages with their parking spaces that are reached via lanes and ramps require much space because of the numerous required lines and with increasing size constitute a safety risk to the user.

Parking systems and methods of parking automobiles are known.

In such a known automatic parking system of the afore-described kind, which is limited to a single parking level, the parking rows are arranged in y-direction in parallel to the entrance zone and the exit zone while the parking columns are arranged perpendicular thereto in x-direction, and the pallets are movable by means of computer-controlled drive means in the direction from an entrance row to an exit row and in at least one row in a direction transversely to the columns (DE 29 23 601 A1). The automobiles are moved on pallets already in the entrance and the exit zones, the pallets in their turn being conveyed to and fro on self-propelling pallet carriers.

An automatic parking system with superposed parking levels is also known, the parking levels being operated by means of lifting units and permitting computer-controlled horizontal movement of pallets in x- and y-direction on the individual parking levels (EP 0,232,725 A1). Plural parking spaces are respectively disposed around one or several lifting unit shafts, the parking spaces being served in spider-fashion by the lifting units both in x- and in y-direction.

The present invention is based on the object of providing a parking system and a method of automatically parking automobiles of the kind known from DE 29 23 601 A1 which permit fully automatic accommodation and placing ready for pick-up even of a large number of automobiles with a minimum of expenditure in terms of space and time at plural parking levels.

SUMMARY OF THE INVENTION

The specified object is solved with a parking system according to the invention in that at least two parking levels are disposed above each other and that in the entrance row to the column spaces of which the automobiles may drive from the entrance zone, and in the exit row from the column spaces of which the automobiles may drive out into the exit zone, a respective lifting unit is provided in each parking row in which the pallets may be moved only in x- and z-directions.

A method of automatically parking automobiles on at least one parking level comprising parking rows and parking columns perpendicular thereto, in which horizontal shifting and parking of the automobiles is effected on pallets, wherein the automobiles are conveyed from an entrance row and under control by a computer are placed ready for pick-up in an exit row, the method in accordance with the invention being characterized in that the automobiles for accommodation at superposed parking levels in each column space located in the entrance row and in the exit row can be conveyed vertically and in x-direction from the entrance row to the exit row can be conveyed horizontally, and that all of the parked automobiles are continually moved in the direction towards the exit row on the shortest possible route, preferably always with the same orientation, i.e. without being turned.

In an especially advantageous embodiment of the method according to the invention, the automobiles are parked preferably in the same column by means of priority control means and are conveyed in the direction towards the exit row in which they have entered.

A further development of the method according to the invention, which is also significant per se, resides in that the computer may at a predetermined time automatically cause the parked automobile to be conveyed into the exit row, especially at the time desired by a user and inputted via a timer into the computer at the commencement of the parking period, or at a time preset by the operator.

Although movement of the pallets in y-direction can be effected only in a row which is then preferably the row adjacent the exit row, it is preferred that the movement in y-direction, just like that in x-direction, should be possible in all parking spaces, i.e. in all of the rows. However, this should not exclude that in some spaces a movement in x- or in y-direction is excluded. This may be due to the necessity for concrete plates between some of the driving fields for reasons of structural support.

In the parking system having at least two parking levels and in the method of parking automobiles in accordance with the present invention it is possible due to the arrangement of the parking system between an entrance row and an exit row provided in parallel thereto, wherein a lifting unit with pallet transport only in x- and z-directions is arranged at each space of these two rows, and due to the consequent transport of the parked automobiles in the direction of the respective same column from the entrance row to the exit row, if possible, to simultaneously park and pick up a great number of automobiles, and the throughput time through the parking system and hence the recall time for placing a parked automobile ready for exiting is minimized.

The space requirements are minimized due to the fact that with the exception of a few maneuvering spaces—at least one maneuvering space for each column—all of the spaces can be provided without any lanes, turning areas or the like in chessboard fashion directly adjacent each other on the respective parking level.

As an alternative to placing the automobile ready for pickup as "preprogrammed" by the user or the operator at a preselected pick-up time it is also conceivable that at an inputting location which is remote from the exit zone the user inputs a desired pick-up time shortly before the automobile is picked up so as to cause the timely transport to the exit row. For instance, such an inputting location may be provided on the platform of a high-speed railway or underground station, in a department store or the like, at walking distance from the parking system which provides for sufficient time to place the automobile in the exit row ready for pick-up and which at least shortens the waiting time for fetching the automobile.

In order to perform simple automatic driving of the pallets in the parking system of the present invention it is provided in accordance with further developments of the invention that, with the exception of the entrance row and the exit row, each space of the parking levels has a stationary driving field with x- and y-driving mechanisms for the x- and y-directions, the driving mechanisms being operated independently of each other under control by the computer, and that the driving mechanisms cooperate non-positively with the pallets for horizontally displacing the pallets selectively in x- or in y-direction, and that each lifting unit at the lowermost parking level respectively comprises an x-driving field with x-driving mechanisms adapted to non-positively cooperate with the pallets for driving the same exclusively in x-direction, wherein x-driving mechanisms for driving the pallets in x-direction are provided on the parking level or levels on top thereof, the x-driving mechanisms being movable beneath the pallets into and out of the lifting path of the same.

The pallets unloaded in the exit row must be returned to the entrance row in countercurrent fashion relative to the pallets loaded with automobiles. If no special measures are provided, the empty pallets will always remain at the parking level and cannot be used as "maneuvering spaces", i.e. spaces at the parking level which are kept free of pallets.

In order to accelerate the flow of especially empty pallets from the exit row into the entrance row and to optimize the number of maneuvering spaces, it is provided in accordance with a further advantageous improvement of the invention that empty pallets can be shifted preferably vertically by means of the lifting units from the exit row to a return transport zone spatially separated from the parking level and can be conveyed in said return transport zone towards the entrance row.

Advantageously, a stacker for empty pallets may be provided in the return transport zone.

BRIEF DESCRIPTION OF THE FIGURES

Below, embodiments of the invention will be described in detail with reference to schematic drawings, in which.

DETAILED DESCRIPTION

Figure 1:
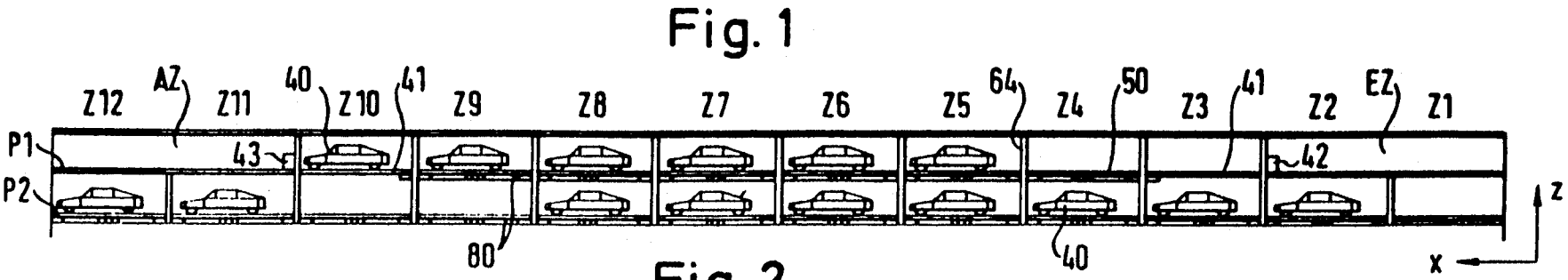
FIG. 1 is a vertical section through a parking system according to the invention.

The parking system illustrated in the drawing comprises two parking levels P1, P2 arranged above each other, the parking level P1 including an entrance zone EZ and an exit zone AZ for entering and exiting automobiles 40. Both parking levels comprise parking columns RA to RK and parking rows Z1 to Z12, the upper parking level P1 including parking rows Z3 to Z10 and the lower parking level P2 additionally including two further parking rows Z1, Z2 and Z11, Z12, respectively, on either side.

The rows and columns are arranged to be perpendicular to each other in chessboard fashion without any lanes therebetween, each column comprising a pallet route. At least two rows Z and one column R are provided.

Except for a small percentage of maneuvering spaces (for instance 8%) each space in the parking system is provided with a pallet 41, the pallets being adapted for transport in longitudinal direction x of the columns, in longitudinal direction y of the rows and in vertical direction z by means of lifting units 20, 21.

In the parking system of the present invention the longitudinal axis of the automobile is always oriented in x-direction while the transverse axis of the automobile is always oriented in y-direction, so that the automobile is not turned.

In order to enable the maximum possible number of automobiles to drive simultaneously from the entrance zone EZ into the entrance row Z3, each column space in this entrance row has its own lifting unit 20. In the same way each column space in the exit row Z10 has its own lifting unit 21, thus enabling simultaneous exiting from the parking system through all columns RA to RK.

For increased flexibility it is possible additionally and preferably to provide all column spaces in row Z8 and possibly also in row Z5 with lifting units.

While operation with parking in the same column R, i.e. in x-direction, into which the automobile has been entered is preferred if possible, the drive means for the y-direction permit lateral shifting of the automobiles 40 without any change in the orientation of the longitudinal axis of the automobile so as to achieve transport and concentration of the automobiles in the direction towards or near the exit row Z10. This makes it possible that in practical use the automobiles 40 are continually moved on the shortest possible route in the direction from the entrance row Z3 towards the exit row Z10.

In order to maintain the operability of the parking system at least one maneuvering space for each column RA to RK must be kept free of pallets. An increase in the number of maneuvering spaces results in a decrease of the throughput time, on the one hand, and in a reduction of the parking capacity, on the other hand. This will require a compromise depending on actual requirements.

If there is a great demand for exiting capacity, the drive means for the movement in y-direction permit transverse shifting between the exiting spaces for unfavorably parked automobiles, i.e. in congested columns and at the far back.

The lifting units 20, 21 and the drive means for moving the pallets 41 in x- and y-direction are operated by means of an electronic control system equipped with a computer 200 in such a way that a minimum throughput time for the occupancy of the parking spaces, which differs unavoidably in practical use, is always achieved. In order to ensure minimum pick-up time the computer is programmed in such a way that the movements of the pallets 41 in y- and z-direction are minimized. A movement in this (these) direction(s) is caused by the computer only when one of the lanes or columns is occupied more than another one by a predetermined factor.

The control system is designed so that a large number of incoming automobiles can simultaneously be accommodated in the parking system. In the illustrated example, a total of sixty spaces can practically be reached at the same time when each of the thirty drive-in boxes in row Z3 includes a respective pile-up space in front thereof.

From the drive-in spaces in the lifting units 20 the automobiles can be moved in x- and z-direction depending on the occupancy of the adjacent parking spaces, the preferred movement being in x-direction as mentioned above.

In the illustrated embodiment the total of sixty drive-in spaces corresponds to 11% of the overall parking capacity of the parking system and is therefore sufficiently great to safely avoid a vehicle back-up on public ground in front of the garage entrance.

Below, the individual components of the driving system illustrated in the figures will be described. These components comprise pallets 41 for accommodating the automobiles 40, driving fields or mechanisms 50 at all parking spaces for driving the pallets 41, and lifting units 20, 21.

Figure 2:
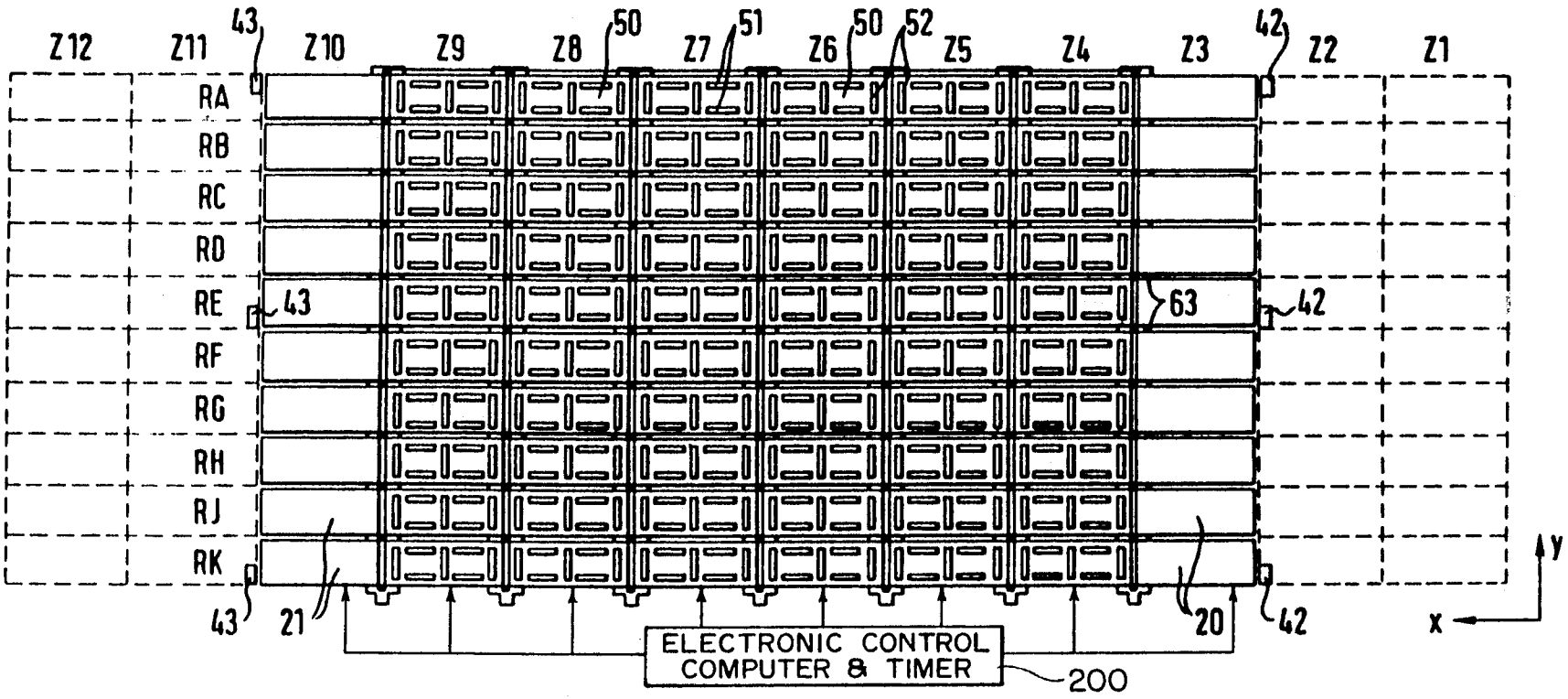
FIG. 2 is a horizontal section of the parking system of FIG. 1 through the upper parking level P1 with the pallets omitted.
Figure 3:
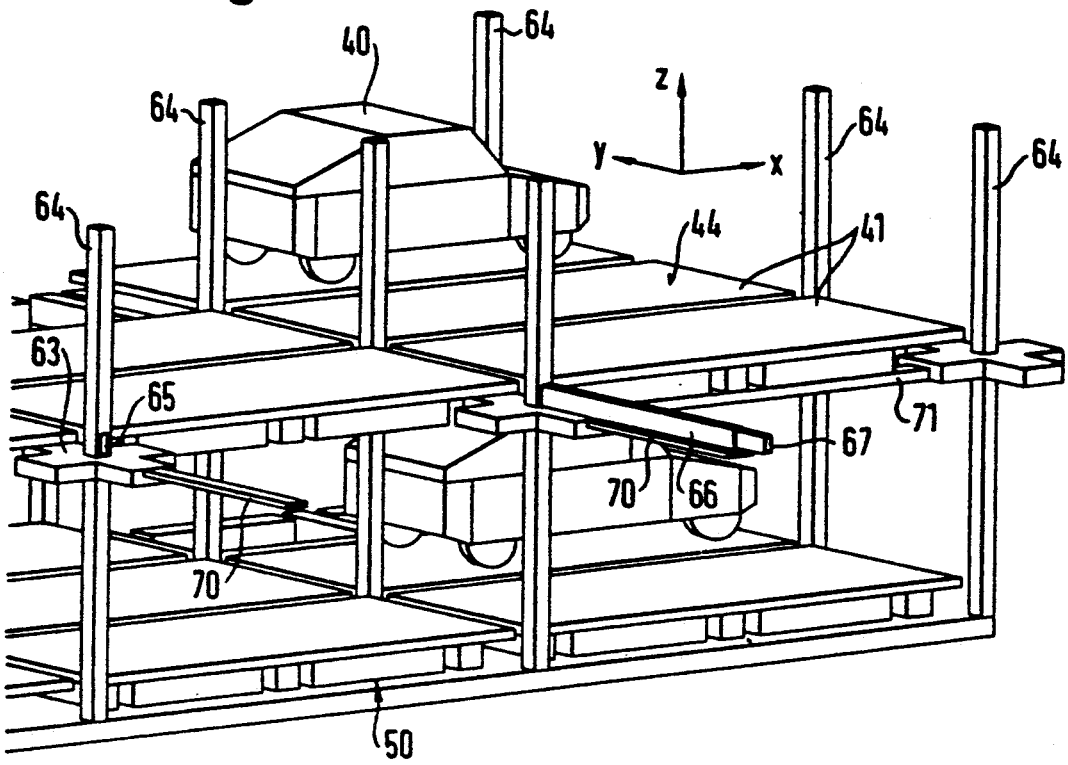
FIG. 3 is a perspective partial view of a parking system according to FIGS. 1, 2.
Figure 7:
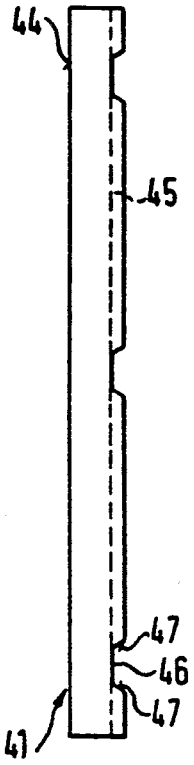
FIGS. 7 and 8 are a side view and a bottom view, respectively, of a pallet for accommodating an automobile, the pallet being adapted to be carried and conveyed by a driving field as shown in FIG. 6.
Figure 8:
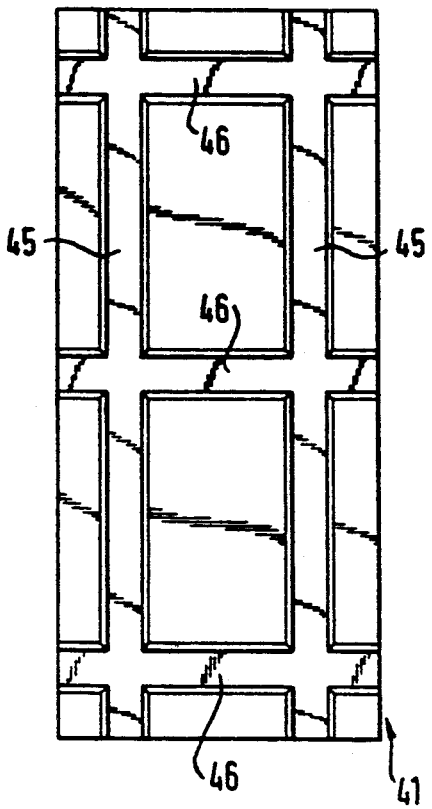

A single pallet 41 is shown in FIG. 7 and FIG. 8 and in conjunction with the other components in FIG. 3. In FIG. 2 the pallets 41 have been omitted so that the driving mechanisms 50 will be directly apparent.

As will be apparent from FIGS. 7 and 8 the pallets 41, which are nearly flat on their top surfaces 44, include rectangularly intersecting guideways 45, 46 on their bottom surfaces along which x-rollers or y-rollers guided by the preferably inclined sidewalls 47 may travel which are supported in the driving mechanism 50 (FIG. 6) and are at least partly driven.

Every driving mechanism 50 includes a flat, grid-like supporting framework 53 which may also utilize portions of the building structure and includes recesses 54 (FIG. 9) for receiving rectangular frames 55 in x- and y-direction. The frames 55 each support sets of four x-rollers 51 and y-rollers 52, respectively, which are likewise identically configured.

Figure 9:
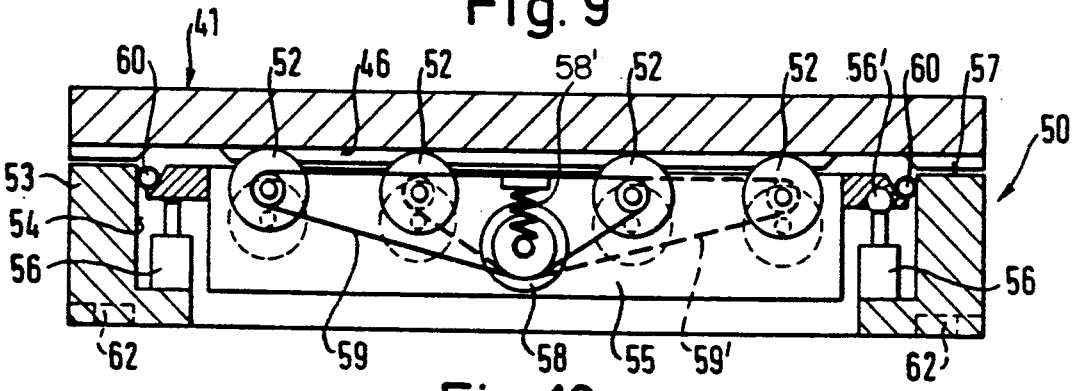
FIG. 9 is an enlarged sectional view through an arrangement comprising drive mechanism and pallet according to FIGS. 6 to 8 in the transport position of the pallet.

Each frame 55 is supported by the grid-like framework 53 via lifting devices in the form of hydraulic cylinders 56 and is operable either directly or indirectly, for instance via parallel links (not illustrated), in such a way that the rollers are either fully retracted in the recess 54 or extend in the elevated operative position beyond the top 57 of the grid-like framework 53 (as illustrated in FIG. 9). The hydraulic cylinders 56 can be actuated either for the frames with the x-rollers 51 or for the frames with the y-rollers so that the pallets disposed above the respective driving mechanism 50 are selectively driven in x- or y-direction. But it is also possible to actuate all of the cylinders 56 in order to have all of the rollers 51, 52 project beyond the top 57 of the grid-like framework 53 whereby the pallet 41 disposed thereabove is arrested. Three hydraulic cylinders are illustrated for each frame. But a single cylinder may also suffice which elevates the rollers via a conventional parallelogram linkage (not illustrated).

Figure 10:
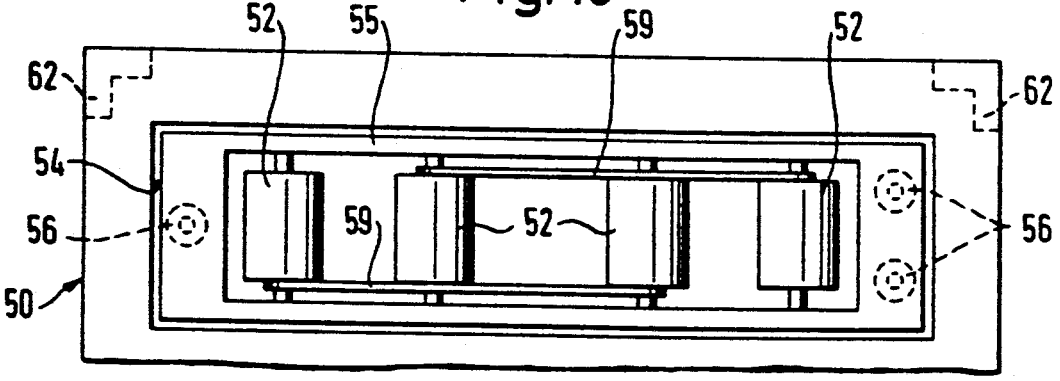
FIG. 10 is a fragmentary plan view showing the driving field of FIG. 9 with the pallet removed.

FIGS. 9 and 10 are enlarged views merely illustrating a frame 55 including y-rollers 52 which cooperate with the y-guideways 46 of the pallets 41. However, arrangement and structure of the frames 55 including the x-rollers 51 are also identical in respect of the driving mechanism for the rollers described below. Each frame comprises an electric motor, for instance an asynchronous motor 58 which drives all of the rollers via chains or toothed belts 59, 59'.

While driving by means of a single toothed belt would be conceivable, one set of rollers in FIG. 10 is driven by the toothed belt 59 and another set of rollers (with partly the same rollers) is driven from the other side of the rollers by means of the toothed belt 59' indicated in dashed lines in FIG. 9. Should one of the two toothed belts 59, 59' break, two or three of the total of four rollers will still be driven from the other side by the remaining toothed belt.

The hydraulic cylinders 56 are actuated via non-illustrated known three-way valves and are preferably biased by springs or the like (not illustrated) in their extended positions so that in case of failure of the hydraulic pressure the pallets 41 will be arrested by the rollers 51, 52 which are all of them elevated. This position corresponds to the normal inoperative position of the pallets on the driving fields (parking position). In this extended state the frames 55 are supported through adjusting pipes 60 illustrated only in FIG. 9 whereby they are retained in a stable position, the adjusting pipes being mounted on the upper inner edges of the recesses 54 of the driving fields.

Each of the hydraulic cylinders 56 is adapted to act on the associated frame 55 through a spherical bearing of the kind indicated at 56' in FIG. 9, whereby further adjustment is possible.

Like the hydraulic cylinders 56 the electric motors 58 are operated under control by the computer and are supported via springs 58' on the frame 55 so as to produce the required prestress of the toothed belts 59, 59'.

Figure 6:
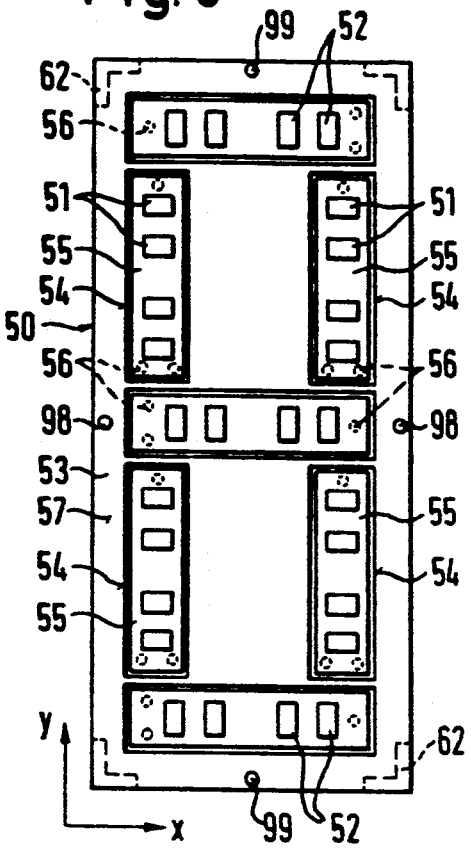
FIG. 6 is a plan view showing a driving field according to the invention which is provided on each parking space of the parking system.

On each of the four sides of each grid-like framework 53 there is illustrated a sensor 98, 99 which cooperates with the computer to sense any misalignment of a pallet 41 on the driving field and to cause a corresponding correcting movement in x- and/or y-direction so that correct positioning of the pallets on the driving fields is ensured at any time (FIG. 6).

The undersid of the grid-like framework 53 is formed with acc es 62 in each of its four corners whereby it is supported on brackets 63 of pillars 64 at both parking levels. In FIG. 3 the driving mechanisms 50 are illustrated without the grid-like framework 53 so that the x- and y-frames in each driving mechanism 50 are visible.

The pillars 64 are arranged in a raster array and distributed through the parking system (see also FIGS. 1 and 2), four pillars 64 being respectively provided at each corner of a driving mechanism 50.

Figure 4:
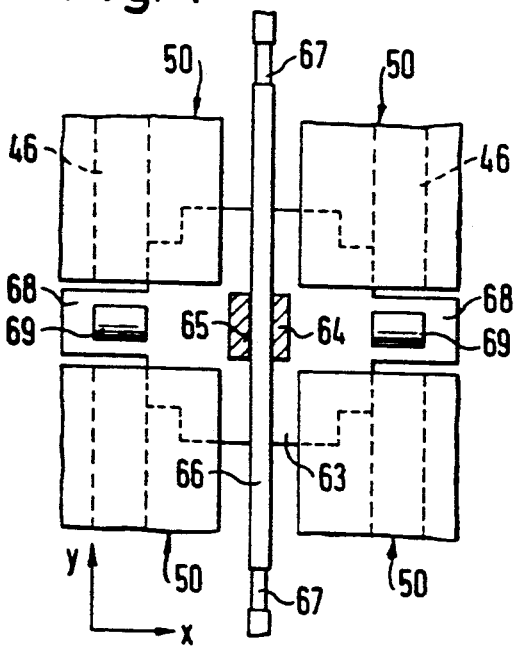
FIG. 4 is a horizontal sectional view through a pillar along the line IV—IV of FIG. 5.
Figure 5:
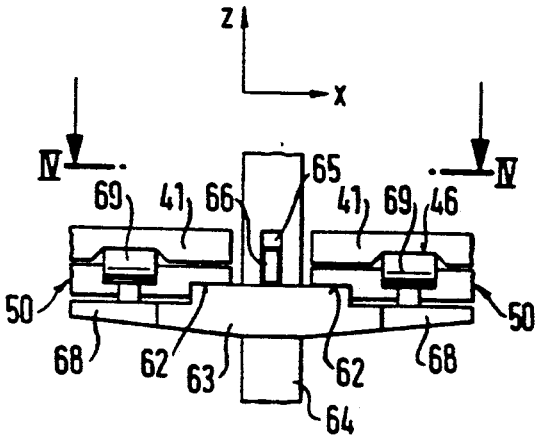
FIG. 5 is a fragmentary view in y-direction of a pillar.

As will be apparent from FIGS. 4 and 5, the pillars 64 have slots 65 extending therethrough above the supporting brackets 63 for fitting supply lines 66 therethrough which house power supply lines for current and hydraulic fluid and the control lines to the computer. The supply lines 66 extend in sections in y-direction across each half of two adjacent driving mechanisms 50 where they are coupled at 67 to neighboring supply lines for instance by means of plug-in connections.

For the pallets 41 to be also guided in the areas intermediate two driving mechanisms 50 the brackets 63 are provided, as shown in FIG. 5, with arms 68 having y-rollers 69 for cooperation with the y-guideways 46 of the pallets 41. Similarly, non-illustrated x-rollers may provide for guiding in x-direction intermediate two driving fields 50.

FIG. 3 shows in addition to what has been described above reinforcing bridges 70 in y-direction and 71 in x-direction intermediate the supporting brackets 63.

Guiding yokes or rollers which are provided on the pillars 64 at the level of the pallets 41 for guiding the pallets in x-direction and y-direction are not illustrated. Where required by statics, non-illustrated vertical disks may be disposed in x-direction between the pillars 64. In the driving system according to the invention it is possible due to the described arrangement and computer control of the drive means that the flow of automobiles may readily "pass around" such parking spaces between disks, while nevertheless even spaces defined by such disks in x- and/or y-direction can be provided with driving fields for accommodating pallets.

The supply lines 66 extending in y-direction may be connected at the margin of the structure to a ring line (not illustrated) whereby a combined network is formed.

The design of the lifting units 20, 21 will be explained in detail with reference to FIGS. 11 to 17.

At the bottom of each lifting unit 20, 21 there is provided a driving field or mechanism 80 which represents a simplified embodiment of the driving mechanism 50 insofar as the y-rollers 52 and the lifting devices 56 are omitted in the driving mechanism 80. There remain grid-like frameworks 83 including recesses 84 for receiving frames 85 for x-rollers 81 so that it is always ensured that pallets 41 that have been moved into lifting units 20 or 21 are driven in x-direction. The rollers 81 always project beyond the top 87 of the frameworks 83 so that they are continually in the ready state for the pallet transport. All of this merely applies to the lowermost level, i.e. the parking level P2 of FIG. 1.

Figure 14:
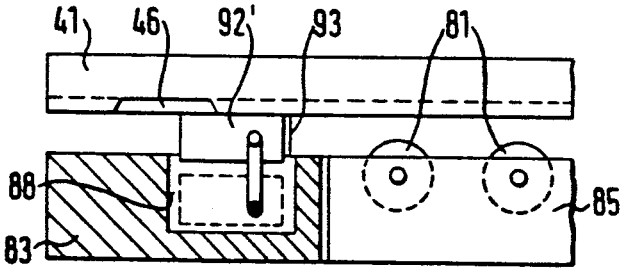
FIGS. 14 and 15 are respectively a partially sectional side view and a plan view of a driving field and a pallet disposed thereabove in the base portion of the lifting unit and a lifting mechanism for the pallets.
Figure 16:
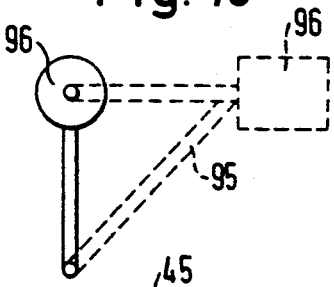
FIGS. 16 and 17 are respectively a side view and a plan view of a rotatable drive means for the horizontal movement of the pallets at levels above the lowermost level of the lifting unit.
Figure 15:
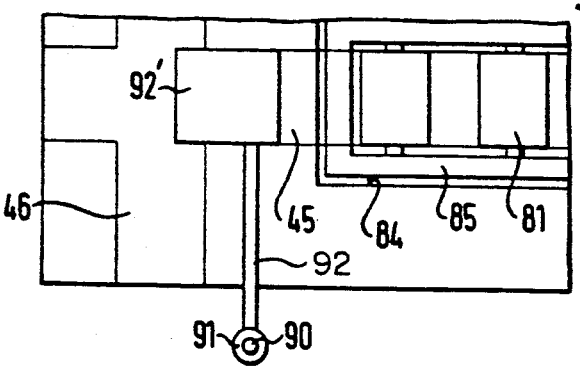
Figure 17:
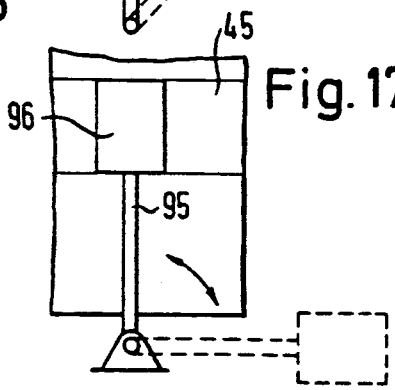

For an automobile 40 to be able to be moved to the parking level P1 provided thereabove, vertical lifting spindles 90 are provided which are rotatably driven by non-illustrated electric motors. Each lifting spindle cooperates with a nut 91 carrying lifting pins 92. The lifting pins may carry a lifting plate 92' as illustrated in FIGS. 14 and 15. Within the framework 83 there are provided recesses 88 for completely retracted accommodation of the lifting pins 92 with the lifting plate, so that upon driving of the pallets 41 in x-direction without lifting the pallets may be driven across the lifting plates 92'.

Figure 11:
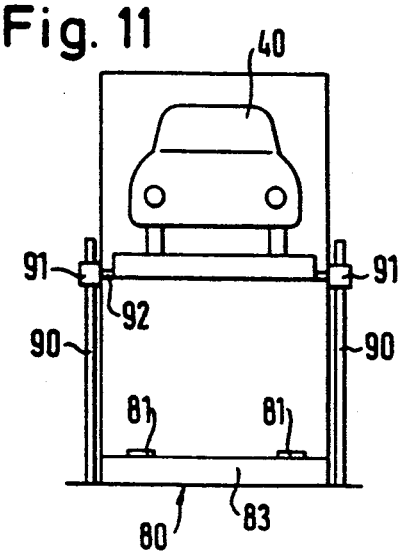
FIGS.11, 12 and 13 are respectively a front view, a side view and a plan view of a lifting unit for conveying the automobiles from one parking level to another one.
Figure 12:
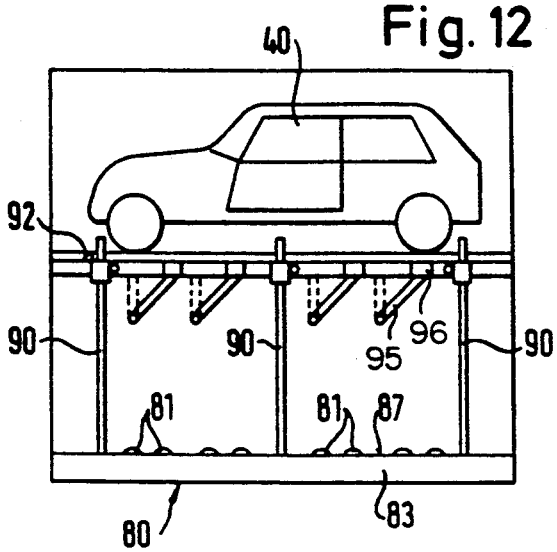
Figure 13:
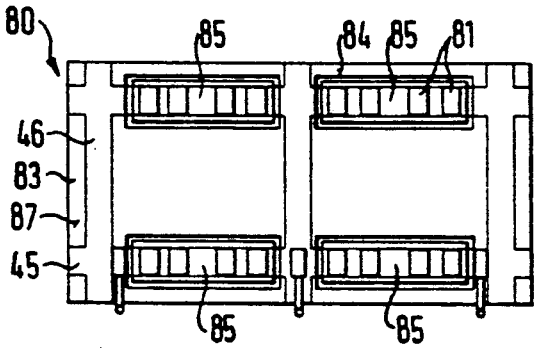

In the position shown in FIG. 11 the pallet 41 is driven by swivel rollers 96 adapted to be swiveled sideways on triangular rods 95 beneath the guideways 46. In FIG. 12 the state of the swivel rollers 96 swiveled to the lateral inoperative position is shown in full lines whereas it is shown in dashed lines in FIGS. 16 and 17 where the operative position is illustrated in full lines. It will be apparent that the swivel rollers 96 are disposed and dimensioned to match the guideways 45 on the underside of the pallets 41. The separately provided swivel roller drive means is not illustrated in this case. This drive means may be supported coaxially with the swivel rollers 96 and may also be carried by the rods 95, or driving may be effected through a universal joint from electric motors which are fixedly mounted sideways and in their turn are controlled by the computer as required. For swiveling the swivel rollers 96 to their operative position a linkage may be used which is not illustrated and is arranged on the side of the lifting unit.

For arresting the pallets 41 in the lifting units at the upper parking level P1, i.e. in the drive-in and the drive-out position, electromagnets or mechanical locking means 93 are provided in the entrance zone at the front of the automobile and in the exit zone at the back thereof.

Below, an example of using a parking system according to the invention will be described.

The user obtains a parking ticket from an automatic machine installed in the entrance.

Having driven into the entrance zone, the user drives into a free entrance box in row Z3 of the columns RA–RK.

An automatic alignment control may give a visual indication to the user as to whether the automobile has been placed sufficiently centrally on the pallet 41. The user then leaves the vehicle, locks it and goes to another automatic machine 42 mounted in front of the entrance box where the parking ticket is provided with a magnetic identification relating to the number of the pallet 41 used by him. Each automatic machine 42 may be provided with input means for a timer by means of which the user may input the desired pick-up time. This pick-up time is marked on the parking ticket and stored in the computer. The timer which is part of the electronic computer control system 200 and pre-programmed by the user in this way causes the computer automatically to actuate the lifting units and driving mechanisms so that the parked automobile is conveyed to the vicinity of the exit column Z10 at the preselected time.

When the user wishes to fetch his automobile he causes it to be transported to the corresponding exit box of the exit column by using his parking ticket in an automatic machine (telemachine) installed at walking distance (e.g. 5 minutes) for instance on a station platform, in a department store, in a bank or the like. When the user arrives at the garage the automobile is ready for pick-up so that there will be no waiting times. In other words the waiting time can be made zero, which is a decisive advantage of the driving system according to the invention.

In order to avoid breaking of a maximum parking time, a parking time limit may be programmed in the computer, for instance up to half an hour after the last high-speed train or underground train on the respective day. At that time the computer will then automatically actuate the lifting units and driving mechanisms for moving the pallets 41 to place the automobile in the exit column Z10 whence it may then, for example, be towed off.

A further useful function of the computer may reside in that, when a column is loaded with parking automobiles at a presettable percentage in excess of the utilization of the other columns, such as 20%, this column is temporarily blocked against the further entry of automobiles 40 until the remaining columns have been loaded accordingly, so that a uniform distribution of the parking automobiles at the parking levels P1, P2 is achieved.

The user who remembers the number of the pallet 41 approached by him may again insert his ticket/his token in automatic exit machines 43 installed in the exit zone AZ so as to directly fetch the automobile parked therein for transport from the parking position to the exit column Z10. By way of a visual indication or the like provided above the exit boxes the user who wants to fetch his automobile is informed where his automobile will be delivered. The number of his pallet will appear on the indication. This is particularly important when the automobile is driven out in a column which is different from the drive-in column.

The described parking system manages with a minimum of space requirement without any ramps and lanes within the parking system and completely without any turntables. It is merely the entrance zone EZ and the exit zone AZ where vehicles are driven, whereby a strict separation between vehicle and pedestrian traffic is achieved so that the safety both of pedestrians and automobiles is increased (theft is practically impossible). Any presence of people within the parking system is thereby avoided. Also, environmental pollution due to running engines in the parking system is prevented because the vehicle engines are turned off already upon drive-in into the entrance row Z3 and are restarted only upon drive-out from the exit row Z10.

Thanks to the described driving system and its electronic control by means of a computer it is possible to achieve minimum throughput times and "zero" waiting times on fetching of the automobile. To this end the flow of automobiles is preferably controlled to be in x-direction, i.e. in the direction of the parking columns, on the shortest possible route from the entrance to the exit. Only the driving mechanisms 50 directly participating in the pallet movement, if possible only two respective adjacent driving mechanisms, will be activated in each case.

Also, the electronic control permits "passing around" driving mechanisms partially defined by disks so that it is possible to reinforce the structure in accordance with static requirements, i.e. to support it by disks wherever this is required due to the loads acting on the structure.

In the parking system according to the invention the efforts in respect of escape routes, ventilation and safety and monitoring devices under rules of structural engineering are minimum because no people are present within the parking system itself.

Figure 18:
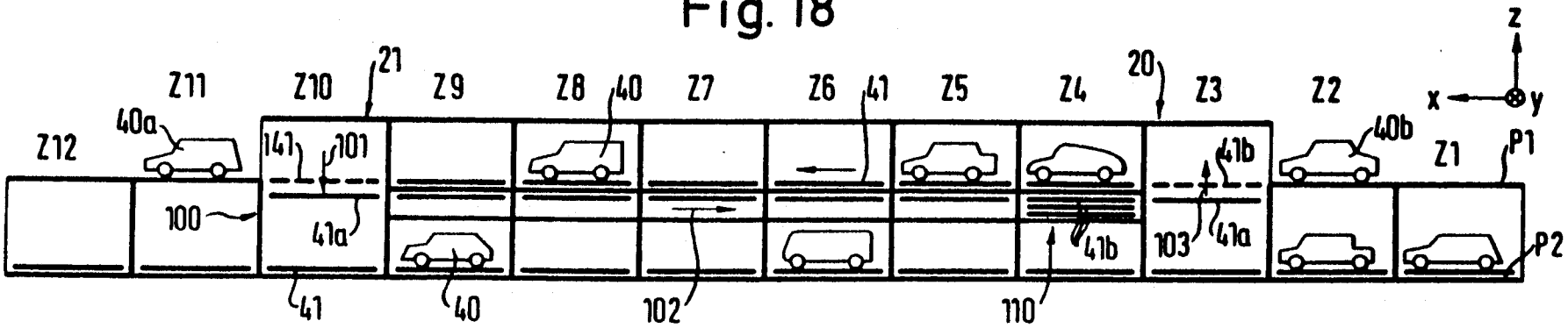
FIG. 18 is a longitudinal sectional view in parking column direction through a parking system according to the invention including the return transport zone and stacker for the pallets.
Figure 19:
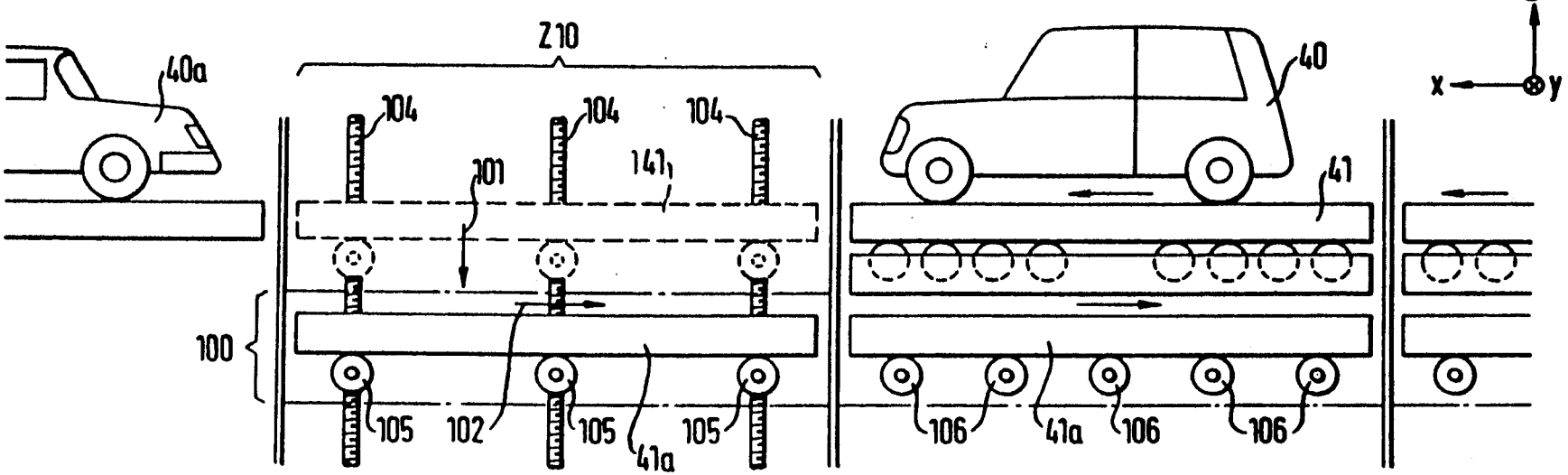
FIG. 19 is an enlarged view of the section of FIG. 18 near the exit row.

In the parking system illustrated in FIG. 18 and 19, in which parts which are identical or have the same function as in the preceding figures are referenced identically, a return transport zone 100 for empty pallets **41*a* is provided immediately beneath the upper parking level P1. Following the exit of an automobile 40*a*, the pallets are left empty in the space in row Z10, the drive-out box, at the parking level P1. This pallet empty state is illustrated in FIGS. 18 and 19 in dashed lines and is referenced 141. In a way which will be described in detail with reference to FIG. 19, the pallets 141 are lowered from this empty state 41 in the direction of the arrow 101 into the return transport zone 100 and are returned in the lowered state in the return transport zone 100 in the direction of the arrow 102 towards the entrance row Z3. In this lowered position the pallets are referenced 41*a* in FIGS. 18 and 19. In the entrance row Z3 the pallets are again elevated in the direction of the arrow 103 to the plane of the parking level. In this elevated state the pallet in FIG. 18 is again shown in dashed lines and referenced 41*b*. The pallet 41*b* is now prepared to receive another automobile 40*b* which is illustrated in the waiting position in front of the entrance row Z3**.

FIG. 19 illustrates a proposed structure for the transfer of pallets 41 from the exit row Z10 to the return transport zone 100. According to FIG. 19 the lifting unit 21 is used to this end, which in this case includes vertical threaded spindles 104 on which nuts are movable up and down by rotation of the threaded spindles, horizontal rollers 105 being rotatably mounted thereon. The rollers 105, which can be driven at least partly, are used at the parking level P1 for driving the pallets 41 in x-direction and in the return transport zone 100 in the opposite direction (arrow 102).

The lifting units, which are in any case necessary for conveying the pallets 41 in z-direction between the two parking levels P1 and P2, are therefore additionally utilized for transferring the pallets in the empty state to the position **41*a* in the return transport zone 100**.

The control system may be designed to that, whenever an automobile is driven out of the exit row Z10 to leave an empty pallet 41 behind, the transfer of the empty pallet to the return transport zone 100 is automatically triggered, whereas the lifting unit moves vertically through the return transport zone without any halt whenever a loaded pallet 41 in the exit row Z10 is to be transferred from the parking level P1 to the parking level P2 or vice versa.

It would also be conceivable for the return transport zone to be provided above the parking level P1 in an area externally of the parking system.

FIG. 18 shows a conventional pallet stacker 110 in the parking row Z4 by means of which pallets indicated at **41*b* may be temporarily stacked until fetched, whereby the height of the return transport zone 100** is utilized.

For conveying the pallets between the rows Z9 and Z4 in the return transport zone 100, FIG. 19 shows rollers 106 which are likewise at least partly driven. Instead of by rollers 106 the pallets **41*a* in this area might also be transported between the rows Z9 and Z4 by means of a conveyor belt or the like. But such a conveyor belt must not reach into the rows Z3 or Z10 because it would obstruct the lifting movement between the parking levels P1 and P2**.

I claim:

1. A parking mechanism for automatically parking motor vehicles (40) on at least two vertically stacked horizontal parking levels (P1, P2) each including a plurality of intersecting parking rows (Z1–Z12) and parking columns (RA–RK), an entrance zone (EZ) and an exit zone (AZ), the parking rows being arranged parallel to the entrance zone and the exit zone in a y-direction and the parking columns being arranged perpendicular thereto in an x-direction, comprising (a) a plurality of motor vehicle pallets (41) for supporting motor vehicles within the parking levels;

(b) first means for driving said pallets in the x-direction from an entrance row (Z3) to an exit row (Z10);

(c) means for driving said pallets in the y-direction transverse to the columns (RA–RK); and (d) a plurality of lifting units (20, 21) for driving said pallets vertically in a z-direction between the parking levels, said lifting units being arranged in the entrance row and in the exit row for each parking column, respectively, each lifting unit including (1) an x-driving mechanism in a lowermost parking level, said x-driving mechanism having second x-driving means for moving said pallets solely in the x-direction; and (2) third x-driving means (96) in the upper parking levels for moving said pallets solely in the x-direction, said third xdriving means being movable beneath said pallets into and out of a lifting path.

2. A parking system as defined in claim 1 wherein at least one row (Z9) in which the pallets are movable transversely to the columns in y-direction (RA–RK) is positioned so as to immediately precede the exit row (Z10) and wherein the pallets (41) in at least one further row (Z7, Z4) are movable transversely (double arrows 31, 32) to the columns (RA–RK) in y-direction.

3. A parking system as defined in claim 1, wherein a lifting unit (22, 23) is provided in at least one further row (Z8, Z5) in each parking column (RA–RK), said further row being disposed at a distance from the entrance row (Z3) and the exit row (Z10).

4. A parking system as defined in claim 1, wherein with the exception of the entrance row (Z3) and the exit row (Z10), a driving mechanism is arranged at each space of the parking levels, said driving mechanism comprising said first x-driving means and said y-driving means, both of which are mutually independently operated under control of a computer and adapted for non-positive cooperation with the pallets.

5. A parking system as defined in claim 4, wherein said first x-driving means and said y-driving means include rollers (51, 52) travelling along bottom surfaces of the pallets (41).

6. A parking system as defined in claim 5, wherein at least one of the x-rollers and y-rollers may be displaced by lifting devices (56) to an operative rest position above the respective driving mechanism.

7. A parking system as defined in claim 6, wherein each driving mechanism further comprises a grid-like framework (54) having recesses (54) for sets of rollers composed of respective axially parallel rollers (51, 52), the rollers of each set of rollers, which are separated into x- and y-direction rollers, being supported in common frames (55) supported by the lifting devices (56) in the recesses (54) of the driving field (50), and further wherein within each frame (55) there is provided a motor operator (58) controlled by a computer for driving at least some of the rollers of the set of rollers through a drive mechanism; the motor operator independently operating on separate rollers through at least two drive mechanisms to provide redundance.

8. A parking system as defined in claim 1, wherein each x-driving mechanism (80) of a lifting unit (20, 21) is configured as a container having first recesses for axially parallel x-rollers (81) which are supported in common frames (85) and respectively constitute a set of rollers, said rollers being adapted to move along a bottom surface of the pallets in recessed guideways (45) extending in x-direction, the container (83) having second recesses (88) for receiving lifting pins (92, 93) and lifting plates fitting in said guideways (45, 46) and adapted to be actuated for lifting and lowering a pallet by lifting devices (90) comprising threaded spindles.

9. A parking system as defined in claim 8, wherein said third x-driving means comprise swivel rollers for driving said pallets from said lifting plates.

10. A parking system as defined in claim 4, wherein the driving mechanisms (50) at the lowermost parking level (P2) are supported on a floor and at the parking levels (P1) provided thereabove are supported with their four corners on spidershaped supporting brackets (63) mounted on pillars (64) at the level of each parking level.

11. A parking system as defined in claim 1, wherein empty pallets (41) are shifted vertically by the lifting units (104, 105) from the exit row (Z10) to a return transport zone (100) which is spatially separated from the parking levels (P1, P2), and are conveyed in the return transport zone (100) in the direction towards the entrance row (Z3).

12. A parking system as defined in claim 11, wherein a stacker (101) for empty pallets (41) is provided in the return transport zone (100).

13. A parking system as defined in claim 4, wherein timers are provided which cause the computer upon actuation by an entering user to convey an automobile to the exit row (Z10) at a desired pick-up time.

* * * * *